US006668806B2

(12) United States Patent
Miller

(10) Patent No.: US 6,668,806 B2
(45) Date of Patent: Dec. 30, 2003

(54) FUEL PUMP ASSEMBLY INCLUDING A FILTER OUTLET TO PUMP INLET ISOLATOR

(75) Inventor: Lee Daniel Miller, Dexter, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/035,759

(22) Filed: Dec. 26, 2001

(65) Prior Publication Data

US 2003/0116141 A1 Jun. 26, 2003

(51) Int. Cl.[7] ..... F02M 33/04
(52) U.S. Cl. ..... 123/509; 417/423.3
(58) Field of Search ..... 417/360, 363, 417/423.3; 123/495, 497, 509, 467, 510–11

(56) References Cited

U.S. PATENT DOCUMENTS

| | | | | |
|---|---|---|---|---|
| 3,910,464 A | * | 10/1975 | Schlanzky | 137/565 |
| 4,590,964 A | * | 5/1986 | Beardmore | 137/565 |
| 4,964,787 A | * | 10/1990 | Hoover | 417/363 |
| 4,971,017 A | | 11/1990 | Beakley et al. | |
| 5,020,978 A | * | 6/1991 | Nashif | 417/360 |
| 5,083,741 A | | 1/1992 | Sancoff | |
| 5,165,867 A | * | 11/1992 | Dockery | 417/363 |
| 5,392,750 A | | 2/1995 | Laue et al. | |
| 5,647,330 A | | 7/1997 | Sawert et al. | |
| 5,758,627 A | | 6/1998 | Minagawa et al. | |
| 5,928,507 A | | 7/1999 | Chiga | |
| 6,102,011 A | | 8/2000 | Meyer et al. | |
| 6,106,244 A | | 8/2000 | Nakatsukasa et al. | |
| 6,123,521 A | | 9/2000 | Mori et al. | |
| 6,125,825 A | | 10/2000 | Sanchez et al. | |
| 6,189,513 B1 | | 2/2001 | Brown et al. | |
| 6,267,103 B1 | | 7/2001 | Ludwig et al. | |

FOREIGN PATENT DOCUMENTS

| | | |
|---|---|---|
| EP | 0619425 | 12/1994 |
| JP | 59070230 | 10/1982 |
| JP | 62155129 | 7/1987 |
| JP | 62155130 | 7/1987 |

* cited by examiner

*Primary Examiner*—Thomas N. Moulis
(74) *Attorney, Agent, or Firm*—MacMillan, Sobanski & Todd, LLC

(57) ABSTRACT

A fuel pump assembly for a fuel delivery module is operable to pressurize fuel from a fuel tank to an internal combustion engine. The fuel pump assembly includes a fuel pump having an inlet and an outlet, an isolator having an inlet end and an outlet end, and a fuel filter having an inlet end and an outlet end. The outlet end of the fuel filter is attached to the inlet end of the isolator. The outlet end of the isolator is attached to the pump inlet.

4 Claims, 2 Drawing Sheets

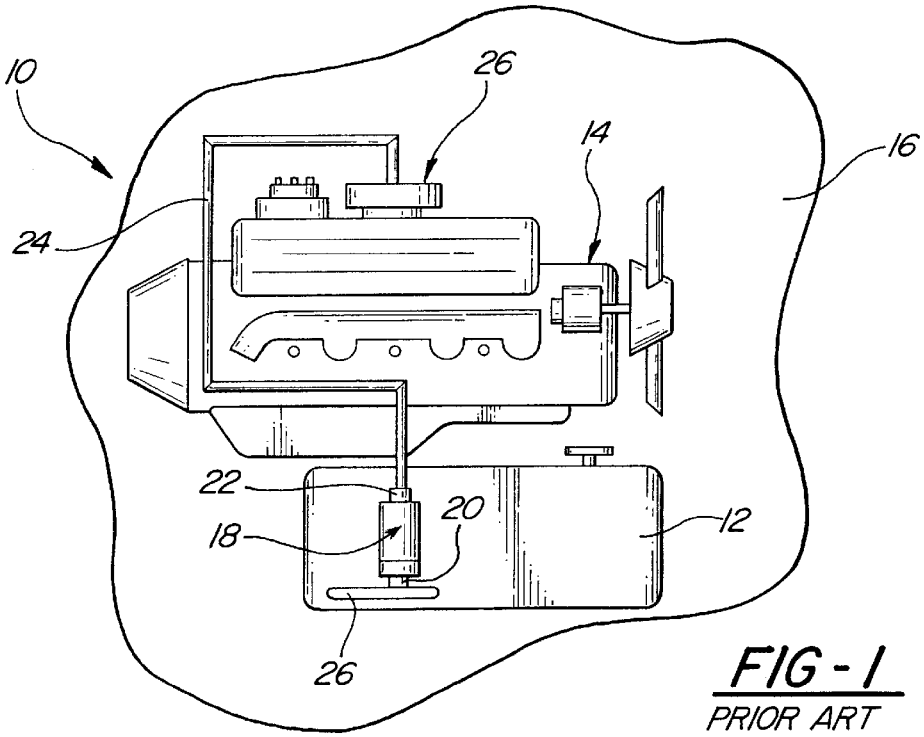
FIG-1
PRIOR ART
FIG-2
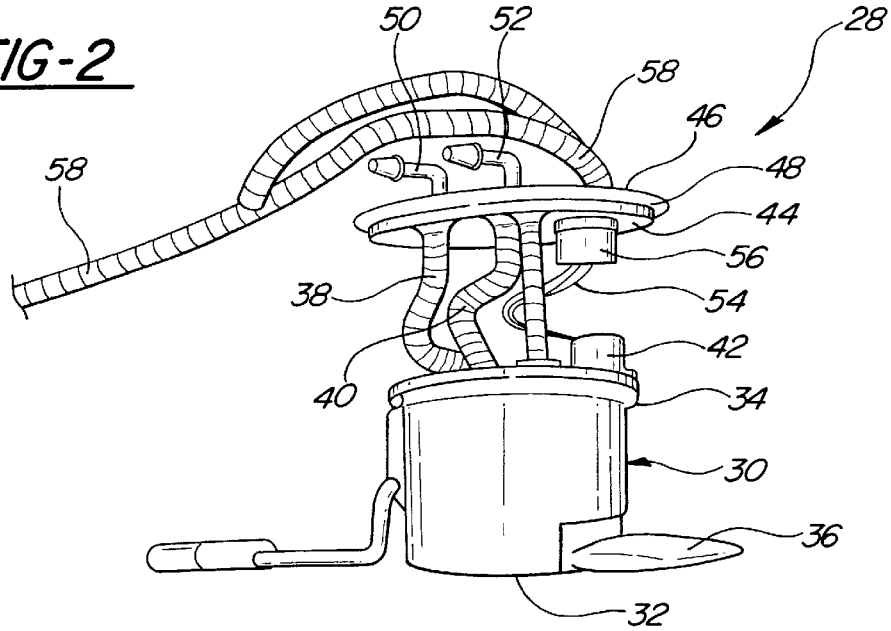

FUEL PUMP ASSEMBLY INCLUDING A FILTER OUTLET TO PUMP INLET ISOLATOR

BACKGROUND OF THE INVENTION

The present invention relates generally to automotive engine fuel delivery systems and, in particular, to a fuel pump assembly including a fuel filter outlet to pump inlet isolator.

Automotive fuel systems, such as those utilizing gasoline or diesel fuel, are well known. An automotive fuel system includes a fuel tank disposed within an automobile body for storing fuel for the internal combustion engine. The fuel tank is typically constructed of steel and is connected to an inlet of a fuel pump. The fuel pump is either a centrifugal or a positive displacement type pump that is driven by an electric motor and an outlet of the fuel pump is connected to a fuel delivery system, typically a fuel injection system or a carburetor. The piping connection from the fuel tank to the inlet of the fuel pump typically includes a fuel filter that protects the internal components of the fuel pump from foreign object damage.

Improvements in manufacturing led to the fuel pump and fuel filter being manufactured as part of a fuel delivery module, which is disposed within the fuel tank. These fuel delivery modules are advantageous because the modules may be preassembled and inserted into the fuel tank later in the assembly process. In addition, fuel delivery modules may be constructed of lighter and cheaper materials, such as plastic. The fuel delivery modules typically attach the outlet of the fuel filter directly to the inlet of the fuel pump, which is mounted in the fuel delivery module. The fuel delivery module, in turn, is mounted on a wall of the fuel tank.

Fuel tanks, especially steel fuel tanks, having the fuel pump or a fuel delivery module disposed therein have notoriously had problems with noise, vibration and harshness (NVH). Vibration problems, in particular, are compounded when the fuel filter, in direct contact with the fuel pump and either the walls of the module or the fuel tank, acts as a conduit through which the vibratory energy travels. Prior art fuel systems have attempted to solve these problems, including the use of damping sleeves, damping seals, damping bushings, and other damping elements, among others. Vibration problems, however, continue to plague fuel systems having integral fuel delivery modules disposed within the fuel tank.

Furthermore, recent developments in noise dampening and insulation have resulted in automobile interiors being much quieter than in previous years. As the noise in the automobile interior is reduced, the driver of the vehicle is now aware of more NVH sources, such as vibration from the automobile's fuel system, that were inaudible in prior art automobiles. The vibration is distracting to the driver and reduces ride comfort, which in turn reduces the automobile quality and overall customer satisfaction with the automobile.

It is a continuing goal in fuel system design to reduce the amount of NVH in the fuel system. It is an object of the invention, therefore, to provide a fuel delivery system that reduces the NVH of prior art fuel systems and does not produce an objectionable amount of noise for the driver of the automobile.

SUMMARY OF THE INVENTION

The present invention concerns a fuel filter outlet to pump inlet isolator for use in an automotive fuel system. The fuel system includes a preferably steel fuel tank disposed within an automobile body for storing and providing fuel to the automobile's internal combustion engine. An aperture in the exterior surface of the fuel tank receives a fuel delivery module.

The fuel delivery module includes a generally tubular, preferably plastic housing. The housing is preferably sized to conform to the aperture in the exterior surface of the fuel tank. The housing performs a variety of functions, including providing a vessel for storing fuel to be used for starting the automobile and providing a pressure vessel for pressurized fuel, after it has left the outlet of the fuel pump, to be stored prior to delivery to the engine. A primary filter having an inlet end and an outlet end extends radially outwardly from the housing. The primary filter functions as the first means for preventing contamination of the automobile's fuel supply by not allowing solid particles to pass from the interior of the fuel tank to the interior of the housing.

The housing receives a fuel pump having an inlet connection and an outlet connection and is typically driven by an electric motor. A plurality of electrical connections for the fuel pump motor are disposed on an upper surface of the housing for providing electrical power to the fuel pump motor. The outlet of the fuel pump is connected to provide fuel to a fuel injector or a carburetor at the engine. Optionally, a fuel return line is connected to a top portion of the housing for recirculating unused fuel, favorably reducing fuel wastage.

The housing also receives a fuel pump filter, which is preferably a screen filter having an fuel inlet and a fuel outlet. The fuel pump filter preferably screens smaller particles than the primary filter on the exterior of the housing. The fuel pump filter is preferably constructed of plastic or similar material and is located adjacent a lower portion of the fuel pump. The inlet of the fuel pump filter is open to the interior of the housing. The outlet of the fuel pump filter is preferably a portion of pipe that is connected to the inlet of the fuel pump.

An isolator according to the present invention connects the outlet of the fuel pump filter to the fuel pump inlet. The insertion of the isolator as part of the fuel delivery module prevents direct contact between the fuel pump and the fuel pump filter, advantageously limiting transfer of vibratory energy from the fuel pump to the housing. The isolator preferably possesses vibration dampening properties and is preferably a piece of flexible tubing or piping having an inlet end and an outlet end that is sized to carry the fuel volume required by the fuel pump. The inlet end of the isolator is connected to the outlet of the fuel pump filter. The outlet end of the isolator is connected to the inlet of the fuel pump. The present invention advantageously incorporates a step manifold as part of a lower surface of the fuel delivery module in order to create the needed space for the addition of the isolator.

The present invention isolates the fuel pump from the fuel pump filter by inserting an isolator between the pump inlet and the fuel pump filter as part of the fuel delivery module. The positioning of this isolator advantageously reduces the transfer of energy from the fuel pump via vibration and pressure pulsations to both the fuel delivery module and the steel fuel tank.

The present invention has shown the ability to reduce by half the amount of noise emanating from the prior art fuel pump, fuel delivery module, and fuel tank, making the sound subjectively non-existent.

The isolator according to the present invention may be an integral component of the fuel pump filter or a separate component of the fuel delivery module, advantageously providing more manufacturing options for the fuel delivery module. Not only does the isolator of the present invention act as a dampening device but the isolator is also a conduit for the fuel and is thus a integral component of both the fuel system and the fuel delivery module.

The present invention may be advantageously used with fuel delivery modules with or without fuel return lines. Furthermore, the present invention may be advantageously used with several models of fuel tanks, fuel pumps, and fuel delivery modules currently in production where it is desirable to reduce the amount of NVH of the fuel system, all while remaining within the scope of the invention.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a schematic view of a prior art system for providing fuel to an internal combustion engine, showing the location of the fuel delivery module in relation to the fuel tank and internal combustion engine;

FIG. 2 is a perspective view of a fuel delivery module in accordance with the present invention.

DESCRIPTION OF THE PREFERRED EMBODIMENT

Figure 3:
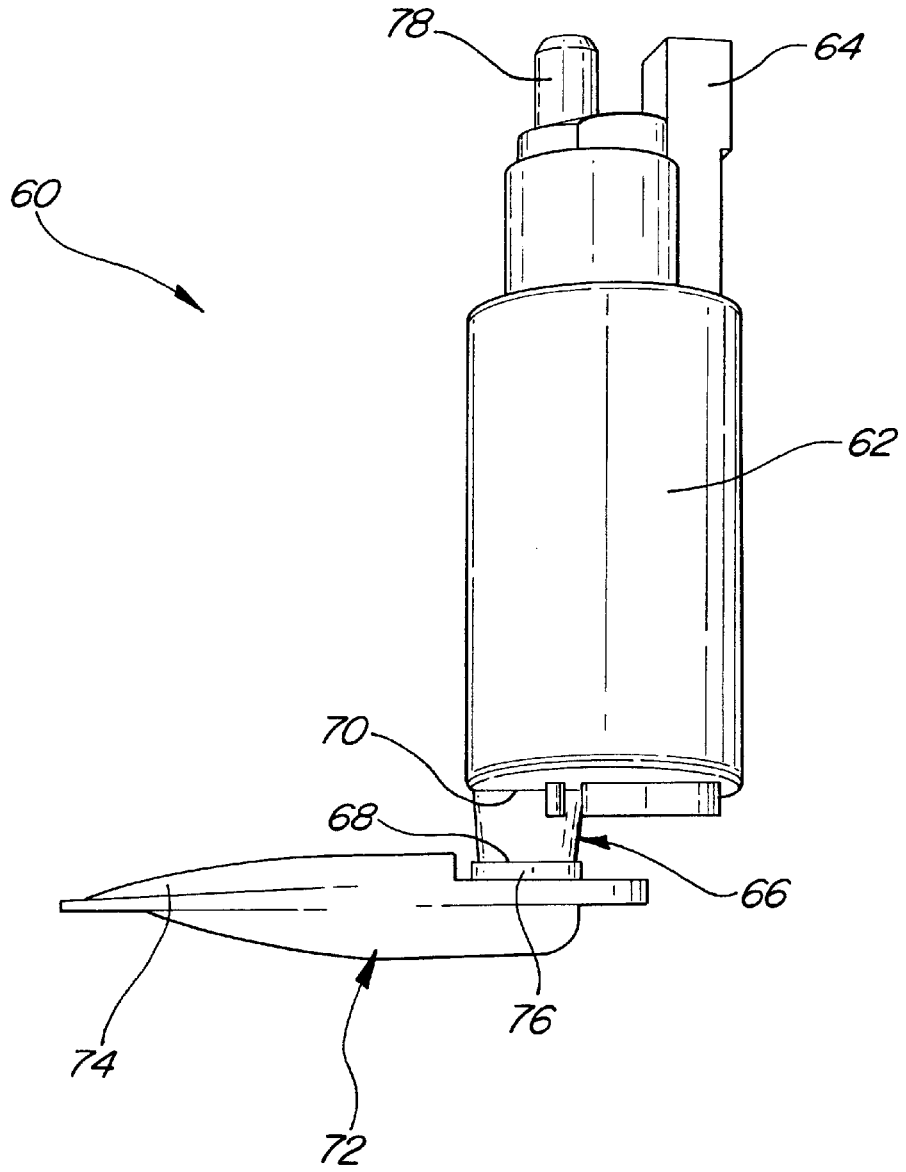
FIG. 3 is a perspective view of a fuel pump and fuel filter including an isolator in accordance with the present invention.

Referring now to FIG. 1, a prior art fuel system is indicated generally at 10. The fuel system 10 provides fuel (not shown) from a fuel tank 12 to an internal combustion engine 14. The fuel tank 12 and the engine 14 are preferably disposed within the body of an automobile 16.

The fuel tank 12 is preferably constructed of steel or a similar material.

A fuel delivery module 18 is disposed within the fuel tank 12. The fuel delivery module 18 includes an inlet 20 adjacent to a lower surface of the fuel tank 12 and an outlet 22 adjacent to an upper surface of the fuel tank 12. The outlet 22 is connected to a fuel supply line 24 that extends to a fuel delivery system 26, such as a fuel injector or carbeurator of the engine 14. A primary filter 26 is attached to the inlet 20 of the fuel delivery module 18 adjacent to a bottom surface of the fuel delivery module 18.

Referring now to FIG. 2, a fuel delivery module in accordance with the present invention is indicated generally at 28. The fuel delivery module 28 is received in a fuel tank (not shown) and preferably extends adjacent to a lower interior surface of the fuel tank. The fuel delivery module 28 includes a generally tubular housing 30 having a closed lower end 32 and a closable upper end 34 that encloses the interior (not shown) of the fuel delivery module 28. The housing 30 is preferably constructed of plastic or similar lightweight material. A primary filter 36 is mounted to and extends radially outwardly from the lower end 32 of the housing 28. The primary filter 36 is preferably constructed of a mesh plastic or similar material for preventing particles contained in the fuel and the fuel tank from entering the fuel pump, outlined in more detail below. A fuel outlet conduit 38, a fuel return conduit 40, and a lower electrical connector 42 each extend upwardly from the upper end 34 of the housing 30.

The fuel outlet conduit 38 and the fuel return conduit 40 each extend through a lower surface 44 and an upper surface 46 of an upper mounting flange 48, which is preferably sized to cooperate with an aperture (not shown) in a wall of a fuel tank, such as the fuel tank 12 of FIG. 1. The fuel outlet conduit 38 extends to an outlet fitting 50, which further extends to the fuel supply system (not shown) of an internal combustion engine (not shown) of an automobile (not shown). The fuel return conduit 40 extends to a return fitting 52, which is attached to piping (not shown) from the fuel return portion of the fuel supply system. Alternatively, the fuel delivery system does not include a fuel return portion and no fuel return conduit 40 extends from the upper end 32 of the housing 28 and no return fitting 52 extends from the upper surface 46 of the upper flange 48.

A plurality of electrical wires 54 extends from the lower electrical connector 42 to an upper electrical connector 56. The upper electrical connector 56 is mounted on the lower surface 44 of the upper flange 48. The upper electrical connector 56 connects to a wire bundle 58, which further extends and is connected to an electrical power supply, such as an alternator (not shown) or a battery (not shown) of the automobile.

Referring now to FIG. 3, a fuel pump assembly is indicated generally at 60. The fuel pump assembly 60 is received in the interior (not shown) of the fuel delivery module housing 30. The fuel pump assembly 60 includes a generally tubular pump body 62 that receives an electrical pump motor (not shown). The pump body 62 is preferably constructed of steel or similar material. A shaft (not shown) extends from the motor to drive a pump impeller (not shown) for supplying pressurized fuel to the fuel system of the automobile. An electrical connector 64 extends from an upper surface of the pump body 62 and is connected to electrical wires (not shown) extending from the lower electrical fitting 42 for supplying electrical power to the pump motor.

An isolator 66 having an inlet 68 end and an outlet end 70 extends from a bottom surface of the pump body 62. The isolator 66 is preferably a piece of flexible tubing or piping possessing vibration dampening properties, such as rubber, neoprene, or the like. The isolator 66 is preferably sized to accommodate a predetermined amount of fuel as required by the fuel pump assembly 60. The outlet 70 of the isolator 66 is preferably attached to one end of an inlet nipple (not shown) extending from the bottom surface of the pump body 62. The other end of the inlet nipple is attached to a piping inlet (not shown) of the pump impeller.

An elongated secondary filter 72 for the fuel pump assembly 60 is mounted to the inlet end 68 of the isolator 66. The secondary filter 72 is preferably constructed of a mesh plastic or similar material for preventing particles contained in the fuel and the fuel tank from entering the fuel pump assembly 60 and includes an inlet 74 and an outlet 76. The outlet 76 of the secondary filter 72 is connected to the inlet 68 of the isolator 66. The plastic mesh of the secondary filter 72 preferably screens smaller particles than does the primary filter 36 for the fuel delivery module 28.

A pump outlet 78 extends from the upper surface of the pump body 62. The pump outlet 78 is attached to a piping outlet (not shown) of the pump impeller in the interior of the pump body 62. The pump outlet 78 is connected (not shown) at an upper end to the fuel outlet conduit 38 for supplying pressurized fuel to the fuel supply system.

In operation, fuel is drawn from the fuel tank through the primary filter 36 and into the interior of the fuel delivery module housing 30. The fuel is then routed from the inlet 74 and to the outlet 76 of the secondary filter 72 and from the inlet end 68 and to the outlet end 70 of the isolator 66. The fuel then enters the inlet piping of the pump impeller, is raised to a higher pressure by the pump impeller, and exits through the pump outlet 78. The fuel then enters the fuel outlet conduit 38, is routed to the outlet fitting 50, the fuel supply system and, ultimately, the internal combustion engine.

As an example, the isolator 66 was tested with a prior art fuel pump, part number VP2F1J-9350-CA, available from Ford Motor Company. As installed on this pump, the isolator 66 was constructed of flexible tubing having a length of approximately 12 to 16 millimeters (mm), an inside diameter of approximately 7 mm, and an outside diameter of approximately 12 mm. If installed between a different fuel pump and fuel filter, the isolator 66 could have other lengths or diameters as required by the respective inlets and outlets of the fuel filter and the fuel pump.

During testing of the VP2F1J-9350-CA pump, baseline decibel measurements were first taken with the pump connected directly to the filter. The average decibel reading after three runs was 45.5 dB. The isolator 66 was then installed between the pump and the fuel filter and decibel measurements taken again. The average decibel reading after three runs with the isolator 66 installed on the pump was 21.6 dB, equating to an unexpected drop of more than 23 dB and making the sound from the VP2F1J-9350CA pump subjectively non-existent.

In accordance with the provisions of the patent statutes, the present invention been described in what is considered to represent its preferred embodiment. However, it should be noted that the invention can be practiced otherwise than as specifically illustrated and described without departing from its spirit or scope.

What is claimed is:

1. A fuel delivery module adapted to be disposed in a fuel tank, the fuel delivery module operable to supply pressurized fuel from the fuel tank to an internal combustion engine, the fuel delivery module comprising:

a closed hollow housing having an inlet and an outlet;

a fuel pump disposed within said housing, said fuel pump having a pump inlet and a pump outlet, said pump outlet being connected to said housing outlet;

a fuel filter disposed within said housing and having an inlet and an outlet; and an isolator constructed of a flexible material and having an inlet end and an outlet end, said inlet end being connected to said fuel filter outlet and said outlet end being connected to said pump inlet, whereby fuel entering said housing inlet enters said fuel filter inlet and flows through said fuel filter and said isolator to said pump inlet, and said isolator dampens vibrations and pressure pulsations generated by operation of said fuel pump.

2. The fuel delivery module according to claim 1 including a primary filter extending outwardly from said housing inlet.

3. The fuel delivery module according to claim 1 wherein said flexible material is rubber.

4. A fuel system for an internal combustion engine comprising:

a fuel tank;

a fuel delivery module housing disposed in said tank and having an inlet and an outlet;

a primary fuel filter extending outwardly from said housing inlet in said tank;

a fuel pump disposed within said housing and having a pump inlet and a pump outlet, said pump outlet being connected to said housing outlet;

a secondary fuel filter disposed in said housing and having an inlet and an outlet; and a generally tubular isolator constructed of a flexible material and having an inlet end and an outlet end, said inlet end being connected to said secondary filter outlet and said outlet end being connected to said pump inlet, whereby when said pump is operated, fuel in said tank flows through said primary filter, said secondary filter and said isolator to said pump inlet, and said isolator dampens vibrations and pressure pulsations generated by operation of said fuel pump.

* * * * *